US007032347B2

(12) United States Patent
Hartman

(10) Patent No.: US 7,032,347 B2
(45) Date of Patent: Apr. 25, 2006

(54) POTTED PLANT HANGER ASSEMBLY

(76) Inventor: John E. Hartman, 785 Mary Ave., Holland, MI (US) 49424

( * ) Notice: Subject to any disclaimer, the term of this patent is extended or adjusted under 35 U.S.C. 154(b) by 0 days.

(21) Appl. No.: 10/627,063

(22) Filed: Jul. 25, 2003

(65) Prior Publication Data

US 2005/0028443 A1 Feb. 10, 2005

(51) Int. Cl.
*A01G 9/02* (2006.01)

(52) U.S. Cl. ..... 47/67

(58) Field of Classification Search ..... 47/67; D26/19

See application file for complete search history.

(56) References Cited

U.S. PATENT DOCUMENTS

| | | | | | |
|---|---|---|---|---|---|
| D18,972 | S | | 3/1889 | Leavitt | |
| 770,738 | A | | 9/1904 | Chessman | |
| 1,572,548 | A | * | 2/1926 | Mattison | 47/67 |
| D77,225 | S | * | 12/1928 | Danz | D6/514 |
| 2,005,334 | A | * | 6/1935 | Casper | 248/328 |
| D222,949 | S | | 2/1972 | Souder | |
| D235,601 | S | | 7/1975 | Lewis | |
| D241,098 | S | | 8/1976 | Durfee et al. | |
| 3,978,612 | A | | 9/1976 | Young | |
| 3,981,099 | A | * | 9/1976 | Dziewulski | 47/67 |
| D241,796 | S | | 10/1976 | Bartlett, III | |
| 4,032,102 | A | | 6/1977 | Wolf et al. | |
| D246,145 | S | | 10/1977 | Hendricks | |
| D250,376 | S | | 11/1978 | Schoenbrun | |
| D250,742 | S | | 1/1979 | Wendler | |
| 4,159,094 | A | | 6/1979 | Stekoll et al. | |
| 4,349,172 | A | | 9/1982 | Banks, Jr. | |
| 4,385,742 | A | * | 5/1983 | Rocquin | 248/318 |
| D274,394 | S | | 6/1984 | Elliott | |
| 4,506,475 | A | | 3/1985 | Elliott | |
| 4,592,166 | A | | 6/1986 | Tendrup et al. | |
| 4,691,473 | A | * | 9/1987 | Ragen | 47/67 |
| 4,875,653 | A | * | 10/1989 | Connolly | 248/332 |
| 5,052,148 | A | | 10/1991 | Sharon et al. | |
| 5,575,447 | A | * | 11/1996 | Griffin | 248/318 |
| 5,779,210 | A | | 7/1998 | Canson et al. | |
| 5,836,109 | A | | 11/1998 | Kunz et al. | |

* cited by examiner

*Primary Examiner*—Michael J. Carone
*Assistant Examiner*—Bret Hayes
(74) *Attorney, Agent, or Firm*—Price, Heneveld, Cooper, DeWitt & Litton, LLP

(57) ABSTRACT

A hanger assembly for hangingly supporting a potted plant that includes a supporting collar and a plurality of flexible support members. The supporting collar includes at least one aperture extending therethrough to receive one or more potted plants. The flexible support members are connected to at least one supporting collar so that the supporting collar may be slidably adjusted along the length of the flexible support member.

19 Claims, 3 Drawing Sheets

POTTED PLANT HANGER ASSEMBLY

FIELD OF THE INVENTION

The present invention relates to a potted plant hanger assembly having easily removable pots, wherein such assembly is easily stored.

BACKGROUND OF THE INVENTION

Potted plant hanger assemblies which position one potted plant above or below another potted plant along the same vertical axis are well known. These plant hanger assemblies are generally constructed of rigid vertical supports. These rigid supports are then typically permanently connected to a support ring and/or directly to a pot containing a potted plant. Previous plant hanger assemblies of this type make storage very cumbersome and the hanger assembly requires a vast amount of storage area. Because the rigid support is typically permanently connected to the potted plant, the pot of the potted plant cannot be readily removed from the assemblies and placed elsewhere while the potted plant hanger assembly is stored.

Heretofore, plant hanger assemblies have not been designed to allow easy removal of a potted plant from the plant hanger assemblies while the assembly remains in a hanging position. These potted plant and hanger assemblies must be removed from a hanging positions when the plant must be removed from its pot, and transplanted elsewhere in order to free-up a pot for inserting another plant. Moreover, prior potted plant hanger assemblies do not allow pots to be interchanged while the assembly is in a hanging position. Changing the vertical arrangement of the potted plants or replacing a pot requires removing the potted plant hanger assembly from the hanging position and either completely disassembling the assembly to rearrange the potted plants, or to interchange a potted plant, or transplanting the plants themselves from one pot to another in order to achieve an alternative arrangement.

Moreover, previous potted plant hanger assemblies are not easily maneuverable to facilitate the service of plants. Prior potted plant hanger assemblies are hung in a fixed position and may not be rotated on a vertical axis to expose various parts of the plant to more sunlight. Additionally, these potted plant hanger assemblies hung in fixed positions are less aesthetically appealing.

Therefore, a plant hanger assembly is desired that allows easy interchangeability associated and supported planting pots, may be stored in a significantly reduced area, and allows for reorientation of the associated pots to provide improved plant care and aesthetic appeal.

SUMMARY OF THE INVENTION

One aspect of the present invention is to provide a potted plant hanger assembly for supporting a potted plant while in a hanging position. The hanger assembly generally includes a supporting collar which has one or more openings adapted to receive one or more potted plants. The hanger assembly further includes one or more flexible support members. The flexible support member is connected to at least one supporting collar. The supporting collar is slidably adjustable along a length of the flexible support member.

Another aspect of the present invention is to provide at least one supporting collar, a plurality of flexible support members, and a plurality of stop members to form a hanger assembly for hangingly supporting a potted plant. The hanger assembly includes at least one supporting collar having at least one opening adapted to receive one or more potted plants.

The collar further includes an outer edge. A plurality of slots extend inwardly from the outer edge of the supporting collar. Each slot has a narrowed throat section and an expanded seat section. The slots also include one or more cone shaped surfaces in communication with the slots. This aspect of the invention also includes one or more flexible support members. The slots of the supporting collar may be slid along a length of one or more flexible support members. This aspect of the hanger assembly also includes one or more stop members. The stop members are connected to the flexible support members at a predetermined location on the flexible support member. The one or more cone shaped surfaces of the supporting collar are supported by the one or more stop members. The stop members prevent the downward movement of the supporting collar along the one or more flexible support members.

Another aspect of the present invention is to provide a potted plant hanger assembly for supporting a potted plant while in a hanging position. The hanger assembly includes one or more potted plants. The hanger assembly further includes one or more flexible support members. The flexible support member is connected to at least one supporting collar. The supporting collar is slidably adjustable along a length of the flexible support member.

The present inventive potted plant hanger assembly allows easy interchangeability/replacement of pots within the hanger assembly without requiring significant disassembly, rearranging or manipulation of the hanger assembly, is collapsible to allow easy storage, allows the assembly to be reoriented so as to provide improved plant care and aesthetic appeal and presentation of the associated plants. The hanger assembly is further efficient in use, economical to manufacture, may be easily operated, and is particularly well adapted for the proposed use.

These and other advantages of the invention will be further understood and appreciated by those skilled in the art by reference to the following written specification, claims, and appended drawings.

DETAILED DESCRIPTION OF PREFERRED EMBODIMENT

Figure 1:
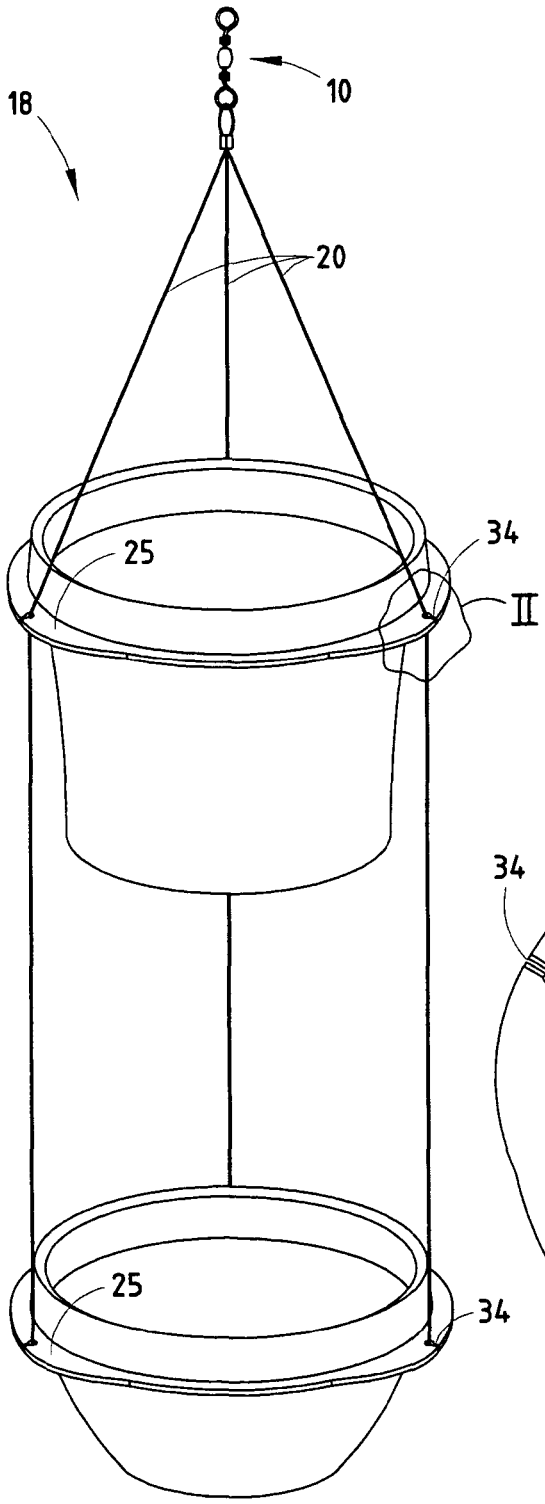
FIG. 1 is a top perspective view of the potted plant hanger assembly.
Figure 2:
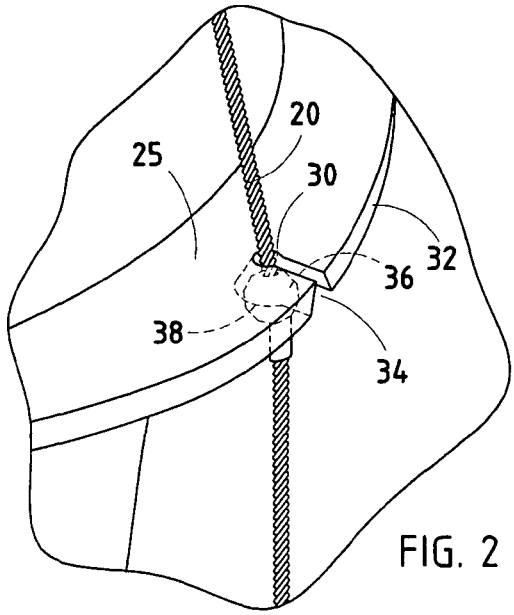
FIG. 2 is an enlarged view of a stop member preventing the downward movement of the supporting collar, wherein the stop member is shown in dashed lines.
Figure 3:
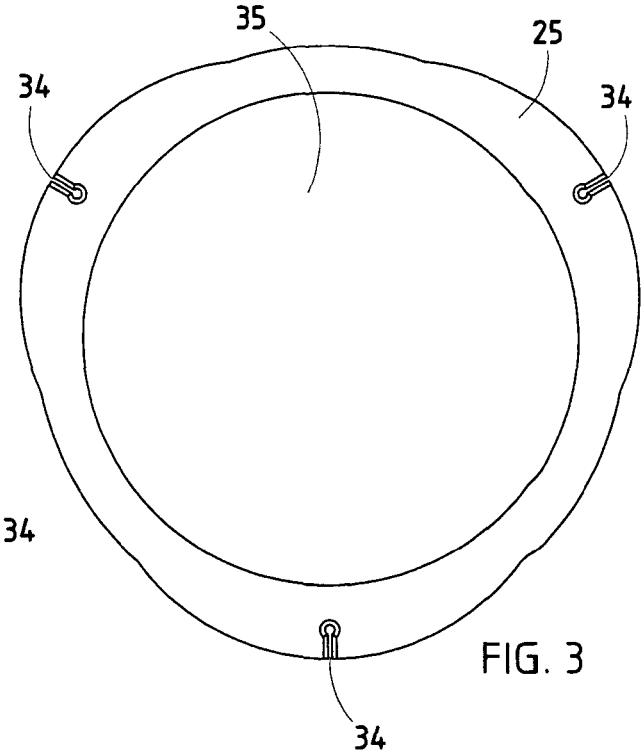
FIG. 3 is a bottom plan view of a supporting collar.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary.

It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 18 (FIG. 1) generally designates a potted plant hanger assembly embodying the present invention, which may be used in residential, commercial, and other similar settings and environments. The hanger assembly 18 includes a plurality of supporting collars 25 each including an inner aperture 35 extending therethrough and adapted to receive a potted plant therein, an outer edge 32, and a plurality of slots 34. The hanger assembly also includes a plurality of flexible support members 20 slidably received within the slots 34, respectively. The hanger assembly 18 further includes a plurality of stop members 36 fixedly connected to the support members 20, and are positioned along the length of the supports members 20 so as to abut the collars 25 and prevent the collars 25 from sliding along the support members 20 past the stop members 36.

The plurality of supporting collars 25 are snappably and slidably connected to the flexible support members 20. Each supporting collar 25 is substantially planar and may be constructed of any material, including but not limited to plastic, metal, wood, or any composite or combination thereof, etc. Each supporting collar 25 may be any shape including, but not limited to circular, rectangular, square, triangular, oval, trapezoidal, etc. Each supporting collar 25 also includes an outer edge 32 and a plurality of slots 34 extending inwardly from the outer edge 32. Each slot 34 has a narrowed throat section 30 and an expanded seat section 37.

The expanded seat section 37 has a frusto-conical surface 38 which is in communication with the slots 34.

The flexible support members 20 offer the novel and advantageous features of being strong enough to support one or more hanging potted plants, while simultaneously being flexible allowing for condensed storage when the assembly 18 is not in use. The plurality of flexible support members 20 may be constructed of metal, plastic, fabric or other flexible material. Examples of flexible support members 20 include cables, rope, etc. Although the illustrated example includes a total of three flexible supports 20, it should be noted that any suitable member of the supports 20 may be utilized.

Spaced at any given length along the plurality of flexible support members 20 are one or more stop members 36. The stop members 36 are fixedly connected to the plurality of flexible support members 20. Specifically, stop members 36 may include one or more components which may be crimped, glued, welded, or otherwise fixedly attached to the flexible support members 20. The stop members 36 may be constructed of any given material such as, but not limited to, plastic, metal, wood, or any composite or combination thereof, etc.

The stop members 36 may be any given shape, however a two component stop member including a spherically shaped component with a flexible support member passing through the center, wherein the spherically shaped component is in contact with a fixed component having the same flexible support member passing through its center is preferred.

Figure 4:
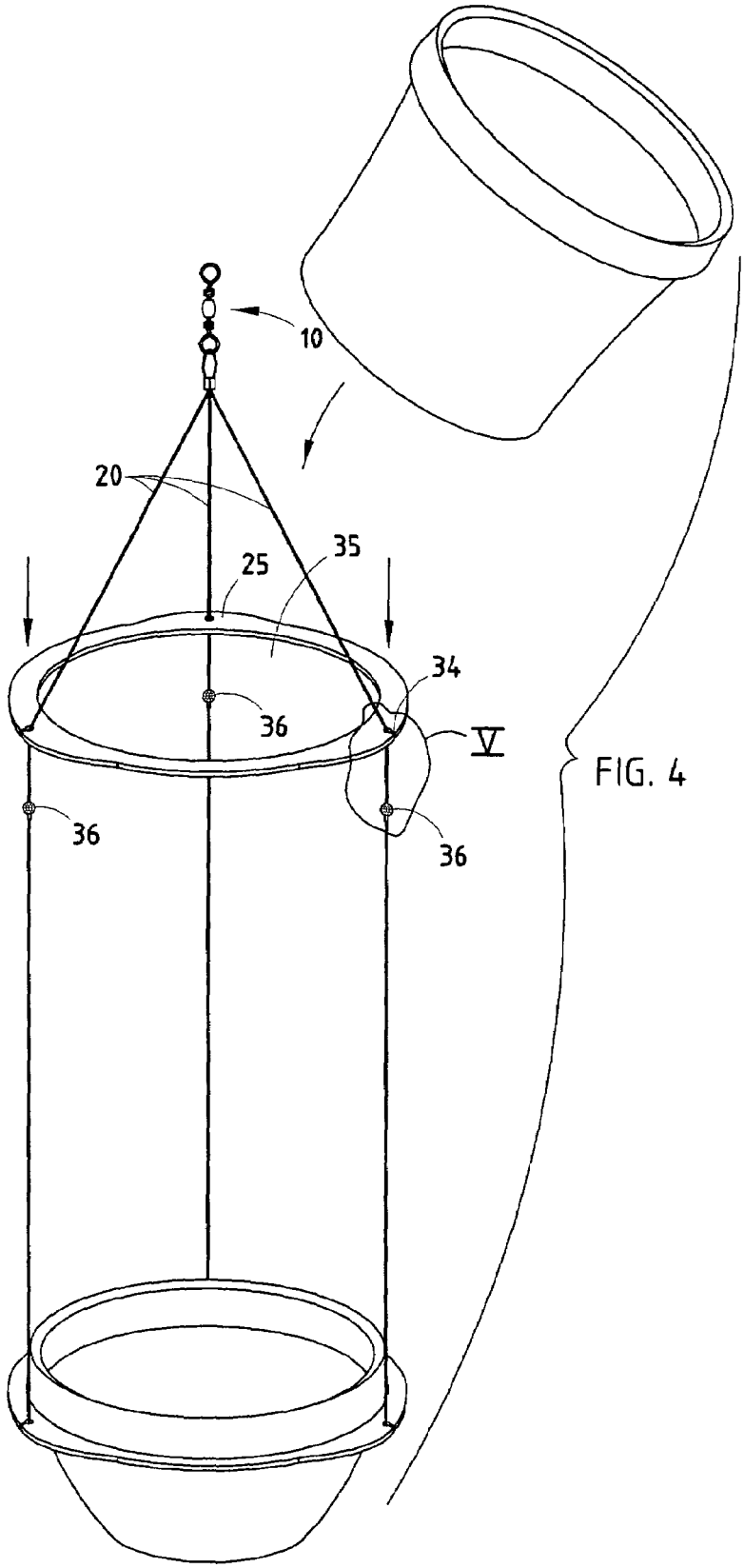
FIG. 4 is a top perspective view of the potted plant hanger assembly having a supporting collar slid upward along a plurality of flexible support members.
Figure 5:
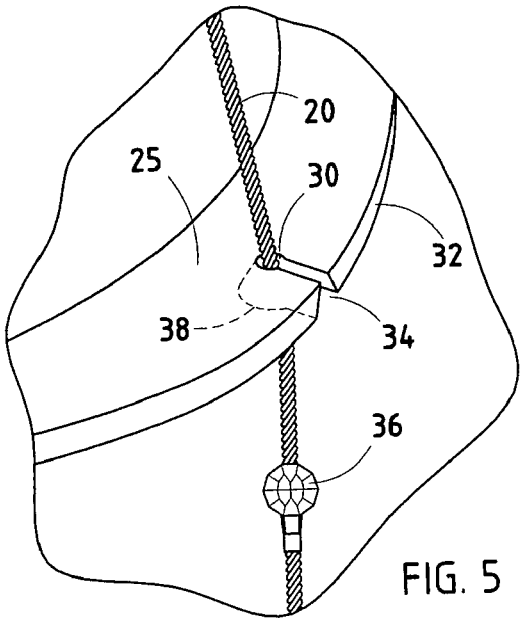
FIG. 5 is an exploded view of a supporting collar slid upward along one of the flexible support members.

In assembly, the plurality of flexible support members 20 are snappably slidably received within the plurality of slots 34 of the supporting collars 25. In operation, the supporting collars 25 may be slid in an upward direction (FIG. 4) along flexible supports members 20. The stop members 40 being spherically shaped are seated within the frusto-conical surface 38 of at least one support collar 25 to prevent downward movement of the support collars 25 with respect to the plurality of flexible support members 20.

Figure 6:
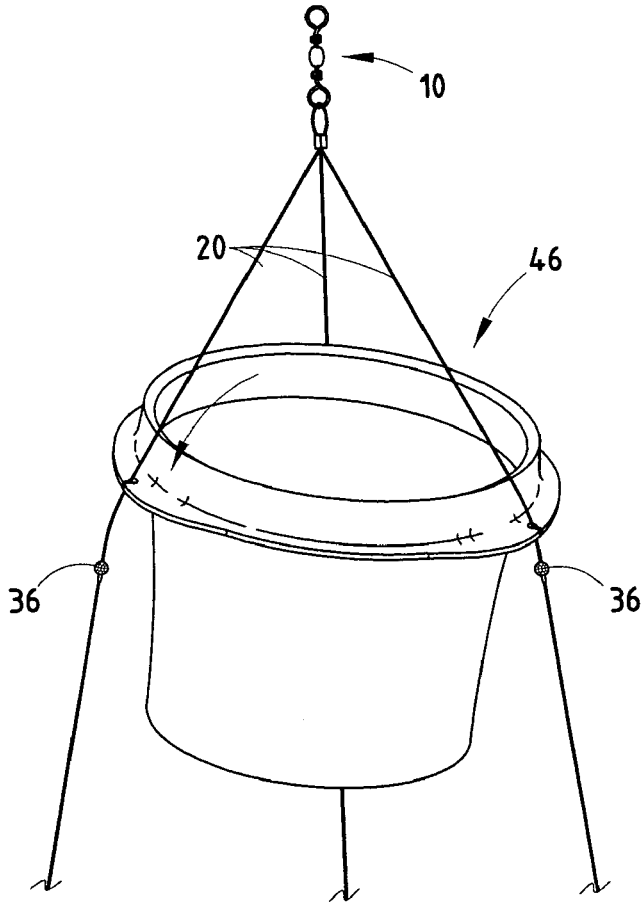
FIG. 6 is a top perspective view of the plant pot slid upward along a plurality of flexible support members.

The potted plant hanger assembly 18 may optionally include a plant pot 46 including an outer edge 48 identical to the outer edge of support collar 25 (FIG. 6). Therefore, the plant pot 46 includes an outer edge 32 having a plurality of slots 34 extending inwardly therefrom. Each slot 34 includes a narrowed throat section 30 and an expanded seat section 37. The expanded seat section 37 has a frusto-conical surface 38 which is in communication with the slots 34. Identical to support collar 25, each outer edge 48 of the plant pot 46 includes slots 50.

In assembly, the plurality of flexible support members 20 are snappably slidably received within the plurality of slots 34 of the plant pot 46. In operation, the plant pot 46 may be slid in an upward direction along flexible supports members 20. The stop members 40 being spherically shaped are seated within the frusto-conical surface 38 of plant pot 46 to prevent downward movement of the plant pot 46 with respect to the plurality of flexible support members 20.

In the illustrated example, potted plant hanger assembly 18 includes swivel support 10 which is connected on a first end to a stationary object (not shown) and connected on a second end to a plurality of flexible support members 20. The first and second ends of the swivel support 10 are pivotable with respect to one another, thereby allowing the potted plant hanger assembly to be easily maneuvered and positioned to facilitate servicing the potted plants and increase aesthetic appeal. Specifically, by turning the assembly 18 while in a hanging position, plants can easily be watered, trimmed, fed, and rotated about a vertical axis to optimize sunlight exposure to each plant.

The present inventive potted plant hanger assembly allows easy interchangeability/replacement of pots within the hanger assembly without requiring significant disassembly, rearranging or manipulation of the hanger assembly, is collapsible to allow easy storage, allows the assembly to be reoriented so as to provide improved plant care and aesthetic appeal and presentation of the associated plants. The hanger assembly is further efficient in use, economical to manufacture, may be easily operated, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A combination hanger assembly and pot for a plant, comprising:

at least one supporting collar comprising at least one inner aperture extending therethrough adapted to receive a potted plant therein, an outer edge, a plurality of slots extending inwardly from the outer edge and each having a narrowed throat section and an expanded seat section, and a plurality of frusto-conical surfaces in communication with the slots;

a pot received in the inner aperture;

a plurality of flexible support members slidably received within the plurality of slots; and a plurality of stop members fixedly connected to the plurality of flexible support members along a length thereof, wherein the stop members contact the frusto-conical surfaces of the at least one support collar and prevent downward movement of the supporting collar with respect to the plurality of flexible support members.

2. The combination hanger assembly and pot of claim 1 wherein the slots snappably receive one or more flexible support members.

3. The combination hanger assembly and pot of claim 1 wherein the support members comprise cables or rope.

4. The combination hanger assembly and pot of claim 1 wherein the frusto-conical surfaces are centered at the seat sections of the slots.

5. The combination hanger assembly and pot of claim 1 wherein the plurality of stop members are crimped, glued, welded or otherwise fixedly attached to the flexible support members.

6. The combination hanger assembly and pot of claim 5 wherein the plurality of stop members are spherically shaped.

7. The combination hanger assembly and pot of claim 1 wherein the supporting collar comprises a substantially planar shape.

8. The combination hanger assembly and pot of claim 1 wherein the supporting collar comprises plastic, metal, wood, or any composite or combination thereof.

9. The combination hanger assembly and pot of claim 1 further comprising a swivel support.

10. A combination hanger assembly and pot for a plant, comprising:

a supporting collar comprising at least one aperture extending therethrough adapted to receive at least one potted plant therein, an outer edge, a plurality of slots extending inwardly from the outer edge and each having opposed side surfaces defining a narrowed throat section and an expanded seat section, the opposed side surfaces at the expanded seat section being tapered to define frusto-conical surfaces;

a pot received in the at least one aperture; and a plurality of flexible support members received in the slots of the supporting collar.

11. The combination hanger assembly and pot of claim 10 wherein the slots snappably receive one or more flexible support members.

12. The combination hanger assembly and pot of claim 10 wherein the support members comprise cables or rope, and including a plurality of stop members on the support members, the stop members abutting the frusto-conical surfaces of the slots.

13. The combination hanger assembly and pot of claim 10 wherein the supporting collar comprises a substantially planar shape.

14. The combination hanger assembly and pot of claim 10 wherein the supporting collar comprises plastic, metal or any composite or combination thereof.

15. The combination hanger assembly and pot of claim 10 further comprising a swivel support.

16. A hanger assembly for supporting potted plants, comprising:

a pot for plants having an outer peripheral surface having a circular shape in cross section and a horizontally outwardly extending lip having a lower surface extending around the outside of the pot;

a ring-like support collar comprising a horizontal web defining an upper surface, a lower surface, an outer peripheral surface and an inner peripheral surface having a generally circular shape in plan view and defining a vertical axis and a hole extending through the collar, the inner peripheral surface defining a lower peripheral edge extending around the collar, the outer peripheral surface including at least three outwardly protruding portions, each outwardly protruding portion including a slot at a center portion of the outwardly protruding portion; a plurality of frusto-conical surfaces in communication with each slot;

a plurality of flexible support members disposed in the slots; and wherein:

the pot is removably positioned in the hole of the support collar with a lower portion of the pot extending below the lower peripheral edge of the inner peripheral surface, the lower surface of the lip of the pot contacting the support collar to support the pot in an upright position.

17. The hanger of claim 16, wherein:

the outer peripheral surface includes portions between the outwardly protruding portions having a constant distance from the vertical axis.

18. The hanger of claim 17, wherein:

the slots define opposed surfaces that are tapered to define a truncated conical shape.

19. The hanger of claim 18, including:

stop members on the flexible support members, the stop members abutting the tapered surfaces of the slots.

* * * * *